US012593913B2

(12) United States Patent
Banner

(10) Patent No.: US 12,593,913 B2
(45) Date of Patent: Apr. 7, 2026

(54) MODULAR FURNISHING BLOCK

(71) Applicant: Morph Bricks Ltd, Lewes (GB)

(72) Inventor: Harvey Banner, Lewes (GB)

(73) Assignee: Morph Bricks Ltd, Lewes (GB)

( * ) Notice: Subject to any disclaimer, the term of this patent is extended or adjusted under 35 U.S.C. 154(b) by 0 days.

(21) Appl. No.: 18/019,299

(22) PCT Filed: Aug. 5, 2021

(86) PCT No.: PCT/GB2021/052028
§ 371 (c)(1),
(2) Date: Feb. 2, 2023

(87) PCT Pub. No.: WO2022/029440
PCT Pub. Date: Feb. 10, 2022

(65) Prior Publication Data

US 2023/0337815 A1 Oct. 26, 2023

(30) Foreign Application Priority Data

Aug. 5, 2020 (GB) ..... 2012163

(51) Int. Cl.
*A47B 47/00* (2006.01)
*A47B 47/04* (2006.01)

(52) U.S. Cl.
CPC ..... *A47B 47/0091* (2013.01); *A47B 47/047* (2013.01); *A47B 2230/0092* (2013.01)

(58) Field of Classification Search
CPC ..... A47B 87/0215; A47B 87/0276; A47B 47/0091; A47B 47/047; A47B 2230/0092
See application file for complete search history.

(56) References Cited

U.S. PATENT DOCUMENTS 3,368,856 A * 2/1968 Tisdall ..... A47B 87/0253 312/111
4,341,050 A * 7/1982 Long ..... E04B 2/24 52/848

(Continued)

FOREIGN PATENT DOCUMENTS

BR 202015030357 11/2016
CN 102633042 8/2012

(Continued)

OTHER PUBLICATIONS

International Search Report and the Written Opinion Dated Oct. 29, 2021 From the International Searching Authority Re. Application No. PCT/GB2021 /052028. (15 Pages).

(Continued)

*Primary Examiner* — Matthew W Ing

(57) ABSTRACT

A modular furnishing block is engageable with another such block to create a modular furnishing block assembly. The block comprises a perimeter wall with a raised first formation on one surface and a recessed second formation on the opposite surface. When two blocks engage, the perimeter walls abut each other. The width of the first formation along the perimeter wall reduces as it rises from the surface, while the width of the second formation reduces as it recesses from the opposite surface. This design allows the first formation to fit progressively more closely within the second formation as the blocks are moved towards engagement. The resulting assembly creates a seamless and secure connection between the modular furnishing blocks, enabling versatile and customizable furniture arrangements.

18 Claims, 13 Drawing Sheets

(56) References Cited

U.S. PATENT DOCUMENTS

| | | | | |
|---|---|---|---|---|
| 5,720,134 | A * | 2/1998 | Kurtz | E04H 12/2292 403/339 |
| 5,803,277 | A * | 9/1998 | Alvarez-Momoitio | A47B 81/04 211/188 |
| 2004/0226492 | A1 | 11/2004 | Carter | |
| 2015/0196121 | A1* | 7/2015 | Chan | A47B 87/0276 312/107 |
| 2018/0112696 | A1* | 4/2018 | Davis | A63H 33/105 |
| 2019/0107131 | A1* | 4/2019 | Davis | B65D 9/34 |

FOREIGN PATENT DOCUMENTS

| | | | |
|---|---|---|---|
| CN | 104532985 | A * | 4/2015 |
| CN | 109322436 | | 2/2019 |
| EP | 0487345 | | 5/1992 |
| GB | 2280892 | | 2/1995 |
| KR | 20150045824 | A * | 4/2015 |
| NL | 9100199 | | 9/1992 |

OTHER PUBLICATIONS

Patents Act 1977: Examination Report under Section 18(3) Dated Jan. 18, 2021 From the Intellectual Property Office of the United Kingdom of Great Britain Re. Application No. GB2012163.8. (4 Pages).

Notification of Office Action Dated Jul. 7, 2025 From the National Intellectual Property Administration of the People's Republic of China, CNIPA Re. Application No. 202180057785.4 and Its Translation Into English. (10 Pages).

* cited by examiner

MODULAR FURNISHING BLOCK

RELATED APPLICATIONS

This application is a National Phase of PCT Patent Application No. PCT/GB2021/052028 having International filing date of Aug. 5, 2021, which claims the benefit of priority of United Kingdom Patent Application No. 2012163.8 filed on Aug. 5, 2020. The contents of the above applications are all incorporated by reference as if fully set forth herein in their entirety.

FIELD AND BACKGROUND OF THE INVENTION

The present disclosure relates to a modular furnishing block. The disclosure relates particularly, but not exclusively, to a modular furnishing block from which indoor or outdoor furnishings, e.g. fixtures and fittings such as furniture, freestanding pods, or partitions, may be assembled.

Furniture may typically comprise items such as chairs, desks, tables, shelves and such like. Most furniture is assembled from a number of parts using fixing means, often in a factory but increasingly in the building in which the furniture will be used. 'Flat-pack' furniture is a common example, in which the furniture arrives as parts in a flat box, and a user assembles the parts into furniture themselves. The parts of such furniture are generally different from each other and provide different functions, such as a base, a leg, an arm and top surface. This results in a predetermined assembly process in which each part must be used for its predetermined purpose. Therefore, there is little or no flexibility in the size and shape of the assembled item of furniture.

Partitions may be used to divide an area within a room or building. A wall partition is generally not load bearing, but if suitable strength is achieved a wall partition can be load bearing, either as part of the structure of the room or building itself, or to support other fixtures or fittings. In general, a wall partition comprises a single part, or a small number of large parts that fit together. Again, the size and shape of the completed assembly is generally predetermined, meaning that bespoke parts, or at least a wide range of parts, are required in order to meet the needs of different users.

The present disclosure seeks to overcome these problems.

SUMMARY OF THE INVENTION

According to a first aspect of the disclosure, there is provided a modular furnishing block, the modular furnishing block being engageable with another such modular furnishing block to provide a modular furnishing block assembly, the modular furnishing block comprising:

- a perimeter wall;
- a first formation raised from a first surface (optionally on the first end) of the perimeter wall, optionally which surface faces towards a first end of the modular furnishing block;
- a second formation recessed from a second face (optionally on the second end) of the perimeter wall, optionally which surface faces towards a second end of the modular furnishing block;
- wherein, when the modular furnishing block engages with the other such modular furnishing block to provide the modular furnishing block assembly, the first surface (or, optionally, end) of the perimeter wall of the modular furnishing block abuts (or rests on) the second surface (or, optionally, end) of the perimeter wall of the other such modular furnishing block,
- and optionally wherein a width of the first formation in a dimension along the perimeter wall at a location of the first formation reduces with a distance by which the first formation is raised away from the first surface and a width of the second formation in a dimension along the perimeter wall at a location of the second formation reduces with a distance by which the second formation is recessed from the second surface such that, as the modular furnishing block is moved towards engagement with the other such modular furnishing block to provide the modular furnishing block assembly, the first formation fits within the second formation progressively more closely in the dimension along the perimeter wall.

Optionally, when the modular furnishing block engages with the other such modular furnishing block to provide the modular furnishing block assembly, the first formation abuts the second formation of the other such modular furnishing block. Optionally, when the modular furnishing block engages with the other such modular furnishing block to provide the modular furnishing block assembly, the second formation abuts the second formation of the other such modular furnishing block.

Optionally, when the modular furnishing block engages with the other such modular furnishing block to provide the modular furnishing block assembly, the first and second formations are concealed by the perimeter wall. That is, the first and second formations may be concealed in the interior of the modular furnishing block assembly.

The first surface is preferably an edge of the perimeter wall. The second surface is preferably an edge of the perimeter wall. As used herein, the term "edge of the perimeter wall" preferably connotes the upper or lower edge of the perimeter wall, i.e. the thinnest edges of the perimeter wall.

The modular furnishing block preferably has open top and bottom ends.

The first formation preferably comprises a tongue. The second formation preferably comprises a groove.

Preferably only a portion of the first surface is used to provide the first formation.

Preferably only a portion of the second surface is used to provide the second formation.

Optionally, the first formation comprises a first mating surface and the second formation comprises a second mating surface, and wherein, when the modular furnishing block engages with the other such modular furnishing block to provide the modular furnishing block assembly, the first (or second) mating surface of the modular furnishing block abuts (and/or rests on) the second (or first) mating surface of the other such modular furnishing block. Preferably, when the modular furnishing block engages with the other such modular furnishing block to provide the modular furnishing block assembly, the second mating surface of the modular furnishing block rests on the first mating surface of the other such modular furnishing block. Preferably, the first mating surface is (part of) the edge of the first formation. Preferably, the second mating surface is (part of) the edge of the second formation. As used herein, the term "edge of the first/second formation" preferably connotes the upper or lower edge of the first/second formation, i.e. the thinnest edges of the first/second formation.

Optionally, first formation is located inwardly from an outer edge of the first surface and the second formation is located inwardly from an outer edge of the second surface.

Optionally, the first formation is located inwardly from an inner edge of the first surface and the second formation is located inwardly from an inner edge of the second surface. That is, the first formation may be inward of the first surface (with respect to the perimeter wall), and the second formation may be inward of the second surface (with respect to the perimeter wall). This may serve to conceal the engaging formations and so reduce the likelihood that these formations are damaged in use.

Optionally, the inner edge of the first surface is aligned with the inner side of the perimeter wall.

Optionally, the inner edge of the second surface is aligned with the inner side of the perimeter wall.

Optionally, the outer edge of the first surface is aligned with the outer edge of the second surface.

Optionally, the area of the first surface is smaller than the total area of the first end of the perimeter wall.

Optionally, the area of the second surface is smaller than the total area of the second end of the perimeter wall.

Optionally, the area of the first mating surface is smaller than the area of the first surface.

Optionally, the area of the first mating surface is the same as the area of the first surface.

Optionally, the area of the first mating surface is smaller than the area of the second mating surface.

Optionally, the area of the first mating surface is the same as the area of the second mating surface.

Optionally, the first formation further comprises a third mating surface raised from a third surface on the first mating surface.

Optionally, the second formation further comprises a fourth mating surface recessed from a fourth surface on the second mating surface.

Optionally, when the modular furnishing block engages with the other such modular furnishing block to provide the modular furnishing block assembly, the third mating surface of the modular furnishing block abuts and/or rests on the fourth mating surface of the other such modular furnishing block.

Optionally, the area of the third surface is smaller than the total area of the first mating surface.

Optionally, the area of the third surface is the same as the total area of the first mating surface.

Optionally, the area of the third mating surface is smaller than the area of the fourth mating surface.

Optionally, the area of the third mating surface is the same as the area of the fourth mating surface.

Optionally, the first formation further comprises at least one ridge extending in a direction towards the outer side of the perimeter wall.

Optionally, the second formation further comprises at least one groove extending in a direction towards the outer side of the perimeter wall.

Optionally, the at least one groove is arranged to accept the at least one ridge.

Optionally, the first formation further comprises a first locking hole.

Optionally, the second formation further comprises a second locking hole.

Optionally, the first locking hole of the block and the second locking hole of the other such block are arranged to align.

Optionally, the perimeter wall further comprises an access hole.

Optionally, the modular furnishing block further comprises a lid coupled to the first end of the perimeter wall.

Optionally, the modular furnishing block further comprises a base coupled to the second end of the perimeter wall.

Optionally, the modular furnishing block further comprises a filler disposed inside the perimeter wall.

Optionally, the perimeter wall forms a square or rectangle.

Optionally, if the perimeter wall forms a square, then the first formation of the block is arranged to engage with the second formation of one other such block.

Optionally, if the perimeter wall forms a rectangle, then the first formation of the block is arranged to engage with the second formation of at least one other such block(s).

Optionally, the perimeter wall is formed of first, second, third, and fourth separable members. Preferably, the members are panels, more preferably wherein each member forms a side of the perimeter wall.

Optionally, the first member and the third member further comprise at least one lug. Preferably the lug is on an edge of the panel provided by the member.

Optionally, the second member and the fourth member comprise at least one cavity. The cavities and lugs may cooperate to enable the members to be joined, which may thereby form the perimeter wall.

Optionally, the cavities are arranged to accept one lug.

Optionally, the modular furnishing block is integrally formed as a single unit/component.

Optionally, the perimeter wall has a shape which is capable of being tessellated, preferably such that a plurality of modular furnishing blocks can tessellate when placed side by side, more preferably wherein said tessellation leaves no gaps between the blocks.

Optionally, the modular furnishing block is formed of plastic, preferably wherein the modular furnishing block is formed of Acrylonitrile Butadiene Styrene, ABS, and more preferably wherein the modular furnishing block is formed of recycled ABS.

Optionally, the modular furnishing block is formed of wood, preferably wherein the modular furnishing block is formed of reclaimed wood.

Optionally, the modular furnishing block is formed of metal, preferably wherein the modular furnishing block is formed of recycled metal.

Optionally, the modular furnishing block further comprises a covering, wherein the covering is applied to the outside of the perimeter wall.

Optionally, the covering is a cladding or paint.

Optionally, the cladding is plastic, preferably wherein the cladding is formed of Acrylonitrile Butadiene Styrene, ABS, and more preferably wherein the cladding is formed of recycled ABS.

Optionally, the cladding is formed of wood, preferably wherein the cladding is formed of reclaimed wood.

Optionally, the cladding is formed of metal, preferably wherein the cladding is formed of recycled metal.

Optionally, the modular furnishing block is for internal construction and/or furniture.

According to a further aspect of the disclosure, there is provided a modular furnishing block assembly, comprising the modular furnishing block described above engaged to at least one other such modular furnishing block. The assembly may further comprise a lid, preferably having a first formation for fitting within the second formation of the modular furnishing block. The assembly may further comprise a base, preferably having a second formation in which the first formation of the modular furnishing block fits. Optionally, the modular furnishing block assembly requires no additional locking or in-fill for use—that is, the assembly is self-locking.

According to a further aspect of the disclosure, there is provided a modular furnishing block kit of parts, comprising the modular furnishing block described above and at least one other such modular furnishing block.

According to a further aspect of the disclosure, there is provided a modular furniture product, comprising the modular furniture block assembly described above.

According to a further aspect of the disclosure, there is provided a modular wall partition, comprising the modular furniture block assembly described above.

As used herein, the term "surface" preferably connotes a plane, which may not be a surface on an outside part of an object (e.g. the surface may be covered by a projection, or the surface may be a plane in space). The term "mating surface", as used herein, preferably connotes a surface on an outside part of an object.

Embodiments of the disclosure are now described, by way of example only, with reference to the accompanying drawings.

DESCRIPTION OF SPECIFIC EMBODIMENTS OF THE INVENTION

First Embodiment

Figure 1A:
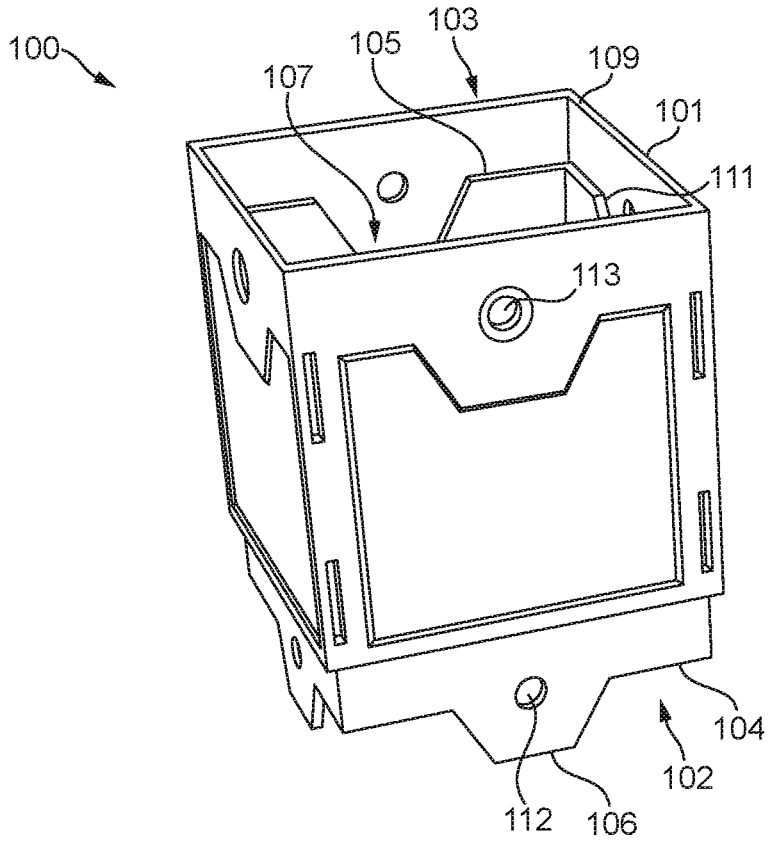
FIG. 1A is a schematic illustration of a modular furnishing block according to a first embodiment of the disclosure.
Figure 7:
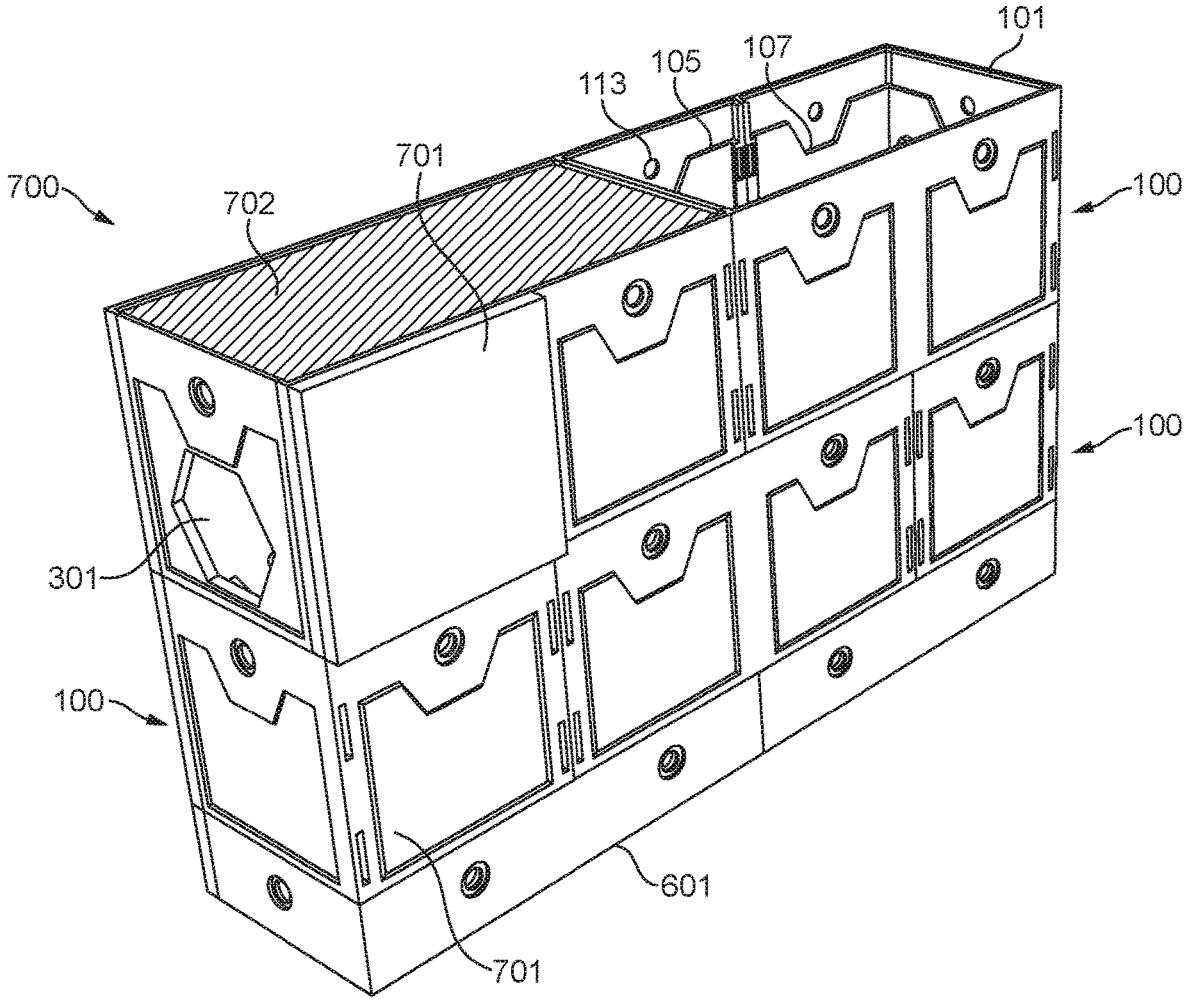
FIG. 7 is a schematic illustration of a modular furnishing block assembly comprising three rectangular modular furnishing blocks of FIG. 1, two square modular furnishing blocks of FIGS. 1A-B and two bases.

Referring to FIG. 1A, according to a first embodiment of the disclosure, a modular furnishing block 100 is provided that, along with other such modular furnishing blocks 100, is used to provide modular furnishings, such as furniture in the form of chairs, desks, tables, shelves and such like or structures such as partitions and such like. Specifically, the modular furnishing block 100 is engageable with one or more other such modular furnishing blocks 100 to provide a modular furnishing block assembly 700, e.g. as shown in FIG. 7. The modular furnishing block 100 can be used with any number of other modular furnishing blocks 100 to provide the modular furnishing block assembly 700, which can then have a wide variety of shapes and sizes. The modular furnishing block assembly 700 may be used inside or outside of a building.

The modular furnishing block 100 comprises a perimeter wall 101. The perimeter wall 101 provides the sides of the modular furnishing block 100, e.g. it provides the side wall or walls of the modular furnishing block 100. In the embodiment illustrated in FIG. 1, the perimeter wall 101 defines a rectangular, specifically a square, perimeter to the modular furnishing block 100. In other embodiments the perimeter wall 101 may define perimeters having other shapes including, but not limited to, a rectangle, a triangle or a circle. However, there is an advantage to choosing a shape that allows the modular furnishing blocks 100 to tessellate when placed side by side, as this allows the modular furnishing assembly 700 to include modular furnishing blocks 100 that are arranged side by side, as well as on top of one another, without necessarily having gaps between the modular furnishing blocks 100. The modular furnishing block includes open upper and lower ends. That is, the modular furnishing block consists of four sides (formed by the perimeter wall), and the two remaining sides are left open.

At a first (open) end of the modular furnishing block 100, which is the lower or bottom end of the modular furnishing block 100 in the orientation shown in FIG. 1, the modular furnishing block 100 has a first formation 102. At a second (open) end 103 of the modular furnishing block 100, which is the upper or top end of the modular furnishing block 100 in the orientation shown in FIG. 1, the modular furnishing block 100 has a second formation 103. The first formation 102 of the modular furnishing block 100 cooperates with the second formation 103 of the other modular furnishing block 100 to allow the modular furnishing blocks 100 to fit together. The formations are adjacent the openings defined by the open ends. When two modular furnishing blocks 100 are fitted together (by way of the formations), two open ends meet such that the blocks form a larger structure that still has two open ends.

Figure 1B:
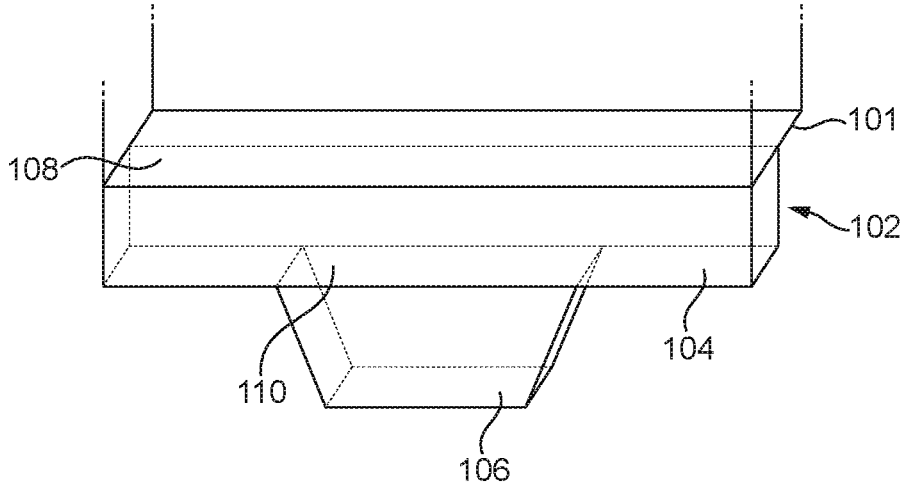
FIG. 1B is a schematic illustration of a first formation of the modular furnishing block of FIG. 1A.

The first formation 102 is shown in more detail in FIG. 1B. As can be seen from the drawing, the first formation 102 is raised from a first surface 108 of the perimeter wall 101, which first surface 108 faces towards (and is located at) the first end of the modular furnishing block 100. The first surface 108 is in effect (part of) the bottom edge of the perimeter wall. In this embodiment, the first formation 102 effectively comprises a tongue extending from the first surface 108. The second formation 103 is recessed from a second surface 109 of the perimeter wall 101, which second surface 109 faces towards (and is located at) the second end 103 of the modular furnishing block 100. The second surface 109 is in effect (part of) the top edge of the perimeter wall. In this embodiment, the first formation 102 effectively comprises a recess in the perimeter wall, extending from the second surface 109.

The first formation 102 has a width that extends along the perimeter wall 101, specifically along the bottom edge of the perimeter wall. Indeed, in the first embodiment, the width is parallel to the perimeter wall 101 (at the location of the first formation 102). The width of the first formation 102 reduces with distance from the first surface 108. In other words, the width of the first formation 102 tapers away from the first surface 108. Similarly, the second formation 103 also has a width that extends along the perimeter wall 101. Again, in the first embodiment, the width of the second formation 103 is parallel to the perimeter wall 101 (at the location of the second formation 103). The width of the second formation 103 reduces with distance from the second surface 109. In other words, the width of the second formation 103 tapers away from the second surface 109. However, it should be noted that the width of the first formation 102 tapers in a direction away from the modular furnishing block 100, or outwardly, as the first formation 102 protrudes from the modular furnishing block 100, and that the width of the second formation 103 tapers in a direction towards the modular furnishing block 100, or inwardly, as the second formation 103 is recessed into the modular furnishing block 100. In this way, the first formation 102 and the second formation 103 are arranged such that, as the modular furnishing block 100 is moved towards engagement with the other modular furnishing block 100 to provide the modular furnishing block assembly 700, the first formation 102 fits within the second formation 103 progressively more closely in the dimension along the perimeter wall 101.

As will be appreciated, in use, the first formation 102 and second formation 103 'slot' together such that the first formation 102 is received within the second formation 103. The respective tapering shapes of the first formation 102 and second formation 103 allow the first formation 102 to be guided into the second formation 103. In other words, the first formation 102 and second formation 103 self-locate.

The tapering shapes of the formations may be provided by use of a variety of different shapes and mating surfaces on the formations, as will be described. The first formation 102 further comprises a first mating surface 104 and the second formation 103 further comprises a second mating surface 105. The first and second mating surfaces are effectively (part of) the edges of each formation. When the modular furnishing block 100 engages with the other such modular furnishing block 100 to provide the modular furnishing block assembly 700 (referred to as the blocks being in an engaged position), the first mating surface 104 of the modular furnishing block 100 abuts, or rests on, the second mating surface 105 of the other such modular furnishing block 100. In such an engaged position, the first end of the perimeter wall 101 of the modular furnishing block 100 also abuts the second end of the perimeter wall 101 of the other such modular furnishing block 100. That is, the first surface 108 of the modular furnishing block abuts the second surface 109 of the other such modular furnishing block 100. It will be appreciated that the distance between the first mating surface 104 and the first surface 108 at all points along the perimeter wall corresponds to the distance between the second mating surface 105 and the second surface 109 at all points along the perimeter wall, such that both the first and second mating surfaces abut and the first and second surfaces 107, 109 abut in the engaged position.

The first and second formations 102, 103 are located inwardly relative to the outer surfaces of the perimeter wall. The first formation 102 is accordingly spaced from an outer edge of the first surface 108 by the (thickness of the) first surface 108, and the second formation 103 is spaced from an outer edge of the second surface 109 by the (thickness of the) second surface 109. The first formation 102 is therefore located inwardly from an inner edge of the first surface 108 and the second formation 103 is located inwardly from an inner edge of the second surface 109. This means that, when the modular furnishing block 100 engages with the other such modular furnishing block 100 to provide the modular furnishing block assembly 700, both the first and second mating surfaces 104, 105 abut and the first and second surfaces 107, 109 abut (with the first and second surfaces being outward relative to the first and second mating surfaces). Additionally, an inner side of the perimeter wall 101 generally abuts an outer side of the first formation 102 when two blocks are in engagement. As such, the inner edge of the first surface 108 is aligned with the inner side of the perimeter wall 101, and the inner edge of the second surface 109 is aligned with the inner side of the perimeter wall 101. The inner side of the perimeter wall has a substantially smooth surface, which may reduce the likelihood of sharp edges and damage to other modular furnishing blocks 100 or components. The outer edge of the first surface 108 is aligned with the outer edge of the second surface 109.

The fit between the first and second formations 102, 103 may be an interference fit, a tight fit, a loose fit or a fit which leaves a small gap between the edges of the first surface 108 and the second surface 109, as long as the first formation 102 and the second formation 103 overlap such that they abut each other. An interference fit may assist in holding the modular furnishing blocks together. If the interaction is an interference or tight fit, it is preferable that this interaction is not the principle load path—in other words, the modular furnishing block 100 is configured such that load is directed via the perimeter wall 101 when the fit between the first and second formations 102, 103 is a tight or interference fit. As will be appreciated, the load path is generally split between the first end of the perimeter wall 101 of the modular furnishing block 100 (which rests on the second end of the perimeter wall 101 of the other such modular furnishing block 100), and the first mating surface 104 of the modular furnishing block 100 (which rests on the second mating surface 105 of the other such modular furnishing block 100).

The area of the first surface 108 is smaller than the total area at the first end of the perimeter wall 101 and the area of the second surface 109 is smaller than the total area at the second end of the perimeter wall 101. In other words, only part of the perimeter wall may be used to provide the formation (there is also an outer part which engages the perimeter wall of another block, when in use). This allows the first formation 102 and the second formation 103 to overlap and engage.

Figure 2:
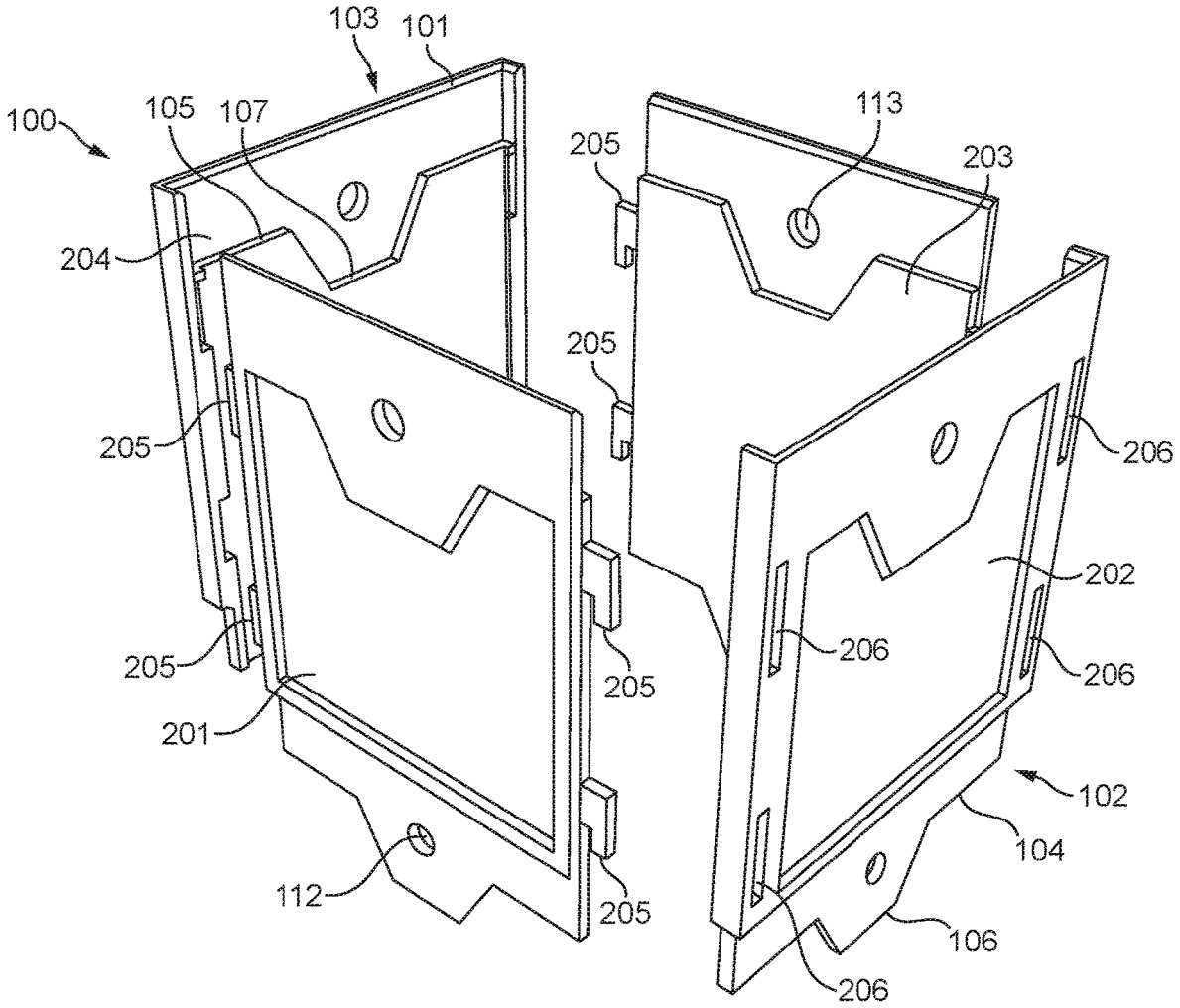
FIG. 2 is a schematic exploded view of the modular furnishing block of FIGS. 1A-B.

The first mating surface 104 is raised from the first end of the perimeter wall 101, forming a projection (referred to as a 'first projection'). The first projection extends beyond the end of the perimeter wall and acts as the body of the first formation 102. This first projection may be solid, as shown in FIGS. 1 and 2, but it may also be hollow or cut away. The size and shape of the first projection, and so the amount of material required and the material positioning, may be dependent on the structural requirements of the modular furnishing block 100 (where a larger projection may provide a firmer connection between blocks, for example).

The area of the first mating surface 104 may be the same as the first surface 108, as illustrated in FIGS. 1 and 2. In other words, the first mating surface 104 may overlie the first surface 108, and may be substantially flat—this results in a straight first projection from the first surface 108 to the first mating surface 104 and the two surfaces being aligned. The formation as a whole, however, reduces in width (or is tapered), as previously described. In an alternative, the first mating surface 104 may not align with the first surface 108.

It is also possible for the area of the first mating surface 104 to be smaller than the area of the first surface 108, in an alternative not shown in the drawings. In such a case, the first mating surface 104 may be e.g. thinner or narrower than the first surface 108. If the first mating surface 104 is positioned inside the first surface 108, with respect to the axis of the first projection, then the first projection would provide a taper (i.e. the surface between the first mating surface 104 and the first surface 108 would be sloped or would otherwise have a gradient). This taper could comprise a linear or non-linear gradient. A linear gradient may provide a self-locating mechanism for engaging the modular furnishing block 100 with another such modular furnishing block 100. A non-linear gradient may also provide a self-locating mechanism; however, it could instead create interference depending on the type of gradient chosen. For example, if the side section of the first projection was a single curve, then interference is unlikely, however if the side section of the first projection was more than one curve then interference may be likely.

The second mating surface 105 is recessed from the first end of the perimeter wall 101, forming a void (referred to as a 'first void'). The first void corresponds to the first projection. In the embodiment illustrated in FIG. 1 the area of second mating surface 105 is the same as the area of the second surface 109 and the two surfaces are aligned. Therefore, the first void can be considered to be generally rectangular in shape, being formed of the void extending from the second surface 109 to the second mating surface 105. It is also possible for the area of the second mating surface 105 to be smaller than the area of the second surface 109, which may result in the first void having a tapered shape.

The embodiment illustrated in FIG. 1 include first and second mating surfaces that are the same area and correspond in position, so that all of the first mating surface 104 rests on all of the second mating surface 105 in the engaged position. It is also possible for the area of the first mating surface 104 to be smaller than the area of the second mating surface 105. This may result in the sides of the first projection and the second void not touching, which may allow for tolerances in the fit of one modular furnishing block 100 to another such modular furnishing block 100.

The mating surfaces illustrated in the embodiment of FIG. 1 are surfaces that face generally towards the upper and lower ends of the furnishing blocks. In other words, the first mating surface 104 is the surface of the first formation 102 that is parallel to the first surface 108, and the second mating surface 105 is the surface of the second formation 103 having that is parallel to the second surface 109. The first and second mating formations accordingly do not contribute to the overall tapering/reduction in width of the formations. Accordingly, further mating surfaces are provided.

The first formation 102 further comprises a third mating surface 106 raised from a third surface 110 on the first mating surface 104, as shown in FIGS. 1 and 2. It will be appreciated that the first mating surface 104 is therefore discontinuous, in that the third surface 110 (which is part of the first mating surface) is at least partially covered by the third mating surface 106. The third mating surface 106 is raised from the first mating surface 104, thereby providing a second projection. As shown in FIG. 1*b* in particular, the second projection (and so the third mating surface 106) is located generally in the middle of the first mating surface 104, preferably exactly in the middle. The second projection shown in FIG. 1B has the shape of an isosceles trapezoid, where the sloped sides of this trapezoid provide the tapering of the first formation 102. The second projection may be solid, as shown in FIGS. 1 and 2, but it may also be hollow or cut away. The amount of material required, and the material positioning, may be dependent on the structural requirements on the modular furnishing block 100.

The second formation 103 similarly further comprises a fourth mating surface 107 recessed from a fourth surface 111 on the second mating surface 105, as shown in FIG. 1. The fourth mating surface 107 is recessed from the second mating surface 105, which provides a further void (referred to as the second void). The second void has a corresponding shape to the second projection. In the embodiment illustrated in FIG. 1 the area of fourth mating surface 107 is smaller than the area of the fourth surface 111 and the fourth mating surface 107 is inside the fourth surface 111. That is, the fourth mating surface 107 is recessed from and is below the fourth surface 111. Therefore, the second void is tapered from the fourth surface 111 to the fourth mating surface 107. In an alternative, it is also possible for the area of the fourth mating surface 107 to be the same as the area of the fourth surface 111, which may result in the second void having square sides.

When the modular furnishing block 100 engages with the other such modular furnishing block 100 to provide the modular furnishing block assembly 700, the third mating surface 106 of the modular furnishing block 100 rests on the further mating surface 107 of the other such modular furnishing block 100. This interaction between the raised nature of third mating surface 106 and the recessed nature of the fourth mating surface 107 may provide an overlap between the first formation 102 of the modular furnishing block 100 and the second formation 103 of the other such modular furnishing block 100.

The outer edge of the third mating surface 106 is aligned with the outer edge of the fourth mating surface 107. The outer edge of the third mating surface 106 and the outer edge of the fourth mating surface 107 are provided between the inner side and the outer side of the perimeter wall 101. The fit between the first and second formations 102, 103 in the engaged position may be an interference fit, a tight fit, a loose fit or a fit which leaves a small gap between the edges of the third mating surface 106 and the fourth mating surface 107, as long as the first formation 102 and the second formation 103 overlap such that their mating surfaces abut each other. If the interaction is an interference or tight fit, it is preferable that this interaction is not the principle load path, as previously described—in other words, the modular furnishing block 100 is configured such that load is directed via the perimeter wall 101 when the fit between the third and fourth formations is a tight or interference fit.

The area of the third mating surface 106 may be the same as the area of the third surface 110, in an alternative not shown in the figures. This scenario would result in a straight third projection from the third surface 110 to the third mating surface 106, if the two surfaces were aligned. It is also possible for the third mating surface 106 to not align with the third surface 110.

It is also possible for the area of the third mating surface 106 to be smaller than the area of the third surface 110. If the third mating surface 106 was positioned inside the third surface 110, with respect to the axis of the third projection, then the third projection provides a taper, as illustrated in the embodiment of FIGS. 1 and 2. That is, there is a sloped surface, or a surface otherwise having a gradient, connecting the first mating surface 104 and third mating surface 106. This taper could comprise a linear or non-linear gradient. A linear gradient may provide a self-locating mechanism for engaging the modular furnishing block 100 with another such modular furnishing block 100. A non-linear gradient may also provide a self-locating mechanism; however, it could also create interference depending on the type of gradient chosen. For example, if the side section of the third projection was a single curve, then interference is unlikely, however if the side section of the third projection was more than one curve then interference may be likely.

The embodiment illustrated in FIGS. 1 and 2 shows the area of the third mating surface 106 to be the same size and position as the area of the fourth mating surface 107 so that all of the third mating surface 106 rests on all of the fourth mating surface 107 in the engaged position. That is, the second protrusion fits into the second void in the engaged position (as the first protrusion fits into the first void). It is also possible for the area of the third mating surface 106 to be smaller than the area of the fourth mating surface 107. This may result in the sides of the third projection and the fourth void not touching, which may allow for tolerances in the fit of one modular furnishing block 100 to another such modular furnishing block 100.

The above-mentioned variations in the area of the first mating surface 104, second mating surface 105, third mating surface 106, fourth mating surface 107, first surface 108, second surface 109, third surface 110 and fourth surface 111 are possible provided that the area of the farthest surface from the perimeter wall 101, in this embodiment the third mating surface 106, is smaller than the area of the first surface 108 (which essentially provides the reduction in width of the first formation 102). It is also possible, in other embodiments, for the modular furnishing block 100 to comprise further mating surfaces such that further projections and voids are provided.

It is preferable that the farthest surface (of the first formation 102) from the perimeter wall 101 is provided at a distance from the perimeter wall 101 which is at least a quarter the height of the perimeter wall 101. This distance may provide a significant overlap between the first formation 102 and the second formation 103 so that the modular furnishing block 100 is stable when engaged with the other such modular furnishing block 100.

The first formation 102 further comprises a first locking hole 112. The first locking hole 112 passes through the side of the first and/or third projection. The first locking hole is arranged generally centrally in the first formation 102. The second formation 103 further comprises a second locking hole 113. The second locking hole 113 passes through the side of the perimeter wall 101 adjacent to the second and/or fourth void. The first locking hole 112 of the modular furnishing block 100 and the second locking hole 113 of the other such modular furnishing block 100 are arranged to align. This alignment of the first locking hole 112 and the second locking hole 113 occurs when the modular furnishing block 100 is engaged with the other such modular furnishing block 100. The alignment of the first locking hole 112 and the second locking hole 113 enables the modular furnishing blocks 100 to be locked to one another with the use of a further locking mechanism. The locking mechanism may be a bar, a pin, a key, a padlock, a clip or any other suitable locking mechanism. Other locking mechanisms, which do not require locking holes, are also possible. The locking holes are circular in shape, and have the same size.

The locking mechanism may provide further stability when modular furnishing block 100 is engaged with another such modular furnishing block 100. However, it is possible for the modular furnishing block 100 engagement stability to be sufficient without the locking mechanism, depending of the extend of the overlap between the first formation 102 and the second formation 103 and the tightness of the fit between the formations.

The perimeter wall 101 may have a square or rectangular shape. A square or rectangular shape is preferable for the perimeter wall 101 as it provides an efficient assembly system whereby the modular furnishing blocks 100 can easily line up with one another, for example like bricks. Other perimeter wall 101 shapes are possible, such as circular, triangular or ovular.

If the perimeter wall 101 comprises a square, then the first formation 102 of the modular furnishing block 100 is arranged to engage with the second formation 103 of one other such modular furnishing block 100. The modular furnishing block 100 comprising a square perimeter wall 101 may engage with another such modular furnishing block 100 comprising a square perimeter wall 101 or may engage with part of another such modular furnishing block 100 comprising a rectangular perimeter wall 101. As will be appreciated, various different modular furnishing blocks 100 (having differently shaped perimeter walls) may be used together.

If the perimeter wall 101 comprises a rectangle, then the first formation 102 of the modular furnishing block 100 is arranged to engage with the second formation 103 of at least one other such modular furnishing block(s) 100. The modular furnishing block 100 comprising a rectangular perimeter wall 101 may engage with a plurality of other such modular furnishing blocks 100 comprising a square or rectangular perimeter wall 101. The number of engaged modular furnishing blocks 100 may depend on the size of the modular furnishing block 100 comprising a rectangular perimeter wall 101.

Examples of engagements between modular furnishing blocks 100 can be found in FIG. 7. In one example, a modular furnishing block 100 comprising a rectangular perimeter wall 101 engages with another such modular furnishing block 100 comprising a rectangular perimeter wall 101 and another such modular furnishing block 100 comprising a square perimeter wall 101.

As shown in the figures, the perimeter wall 101 may include a cut-out portion on each side of its exterior that may, in part, generally correspond to the shape of the second formation 103 on the interior side of the perimeter wall. Specifically, the cut-out portion may be generally square-shaped, but at its top portion generally correspond to the (underlying) shape of the second formation 103. The use of the cut-out portion may reduce the material used in the block.

Referring to FIG. 2, the perimeter wall 101 may be formed of separable members. Specifically, the perimeter wall may be formed of four members (a first member 201, a second member 202, a third member 203 and a fourth member 204). If the perimeter wall 101 shape is square or rectangular then the four members will form the four sides of the square or rectangle. It is also possible for the perimeter wall 101 to comprise one continuous member. Using one continuous member may be preferable for assembly as there are less parts, however, using four members may allow the modular furnishing block 100 to be 'flat-packed' for transportation.

As will be appreciated, the modular furnishing block may comprise a plurality of third mating surfaces 106 (i.e. a plurality of 'second projections'). In the embodiment shown in FIG. 2, each of the members of the perimeter wall 101 comprise a third mating surface 106. Therefore, in the embodiment shown in FIG. 2, the modular furnishing block 100 comprises a total of four third mating surfaces 106. The modular furnishing block 100 further comprises four corresponding fourth mating surfaces 107. It is also possible for there to be a different number of third mating surfaces 106 and fourth mating surfaces 107 to the number of members.

It may be suitable for every other member to comprise a third mating surface 106 and a fourth mating surface 107, or each member may comprise two third mating surfaces 106 and two fourth mating surfaces 107, for example. The upper limit of the number of third mating surfaces 106 and fourth mating surfaces 107 may be defined by the size of the perimeter wall 101. It also may be more efficient, in terms of manufacturing, for each of the members to be identical (at least in terms of the formations used).

In the embodiment of FIG. 2, the first member 201 and the third member 203 further comprise at least one lug 205. The second member 202 and the third member 204 may further comprise at least one cavity 206. The at least one cavity 206 is arranged to accept one lug 205 per cavity 206. It is also possible for the cavity 206 to accept more than one lug 205. The embodiment illustrated in FIG. 2 shows the lug 205 comprising a mortice and tenon style joint with an additional downward projection. The first and third members 201 include two lugs on each edge, which are configured to engage with corresponding cavities in the second and fourth members. The first member 201 and the third member 203 may be engaged to the second member 202 and the fourth member 204 by inserting the lugs 205 into the cavities 206. The first member 201 and third member 203 may also be slid relative to the second member 202 and the fourth member 204 in order to engage the downward projection of the lugs 205 with the corresponding arrangement in the cavities 206. This downward projection of the lug 205 may allow the members to fit together and lock. It is also possible for the lug 205 not to comprise a downward projection and the locking between the lug 205 and the cavity 206 may be provided by an interference fit, adhesive or fastening means. As will be appreciated, any alternative arrangement of lugs and cavities may also be used to allow the four members to be formed into the perimeter wall.

The second and fourth members further comprise wall sections at their edges (i.e. the edges that contact the first and third members). The wall sections extend perpendicularly to the body of the second and fourth members, such that, when the members are engaged to form a perimeter wall, the wall sections overlie the first and third members. When the members are engaged, the wall sections extend a short distance over the first and third members and preferably abut the first and third members. This may improve the strength of the perimeter wall.

Figure 3:
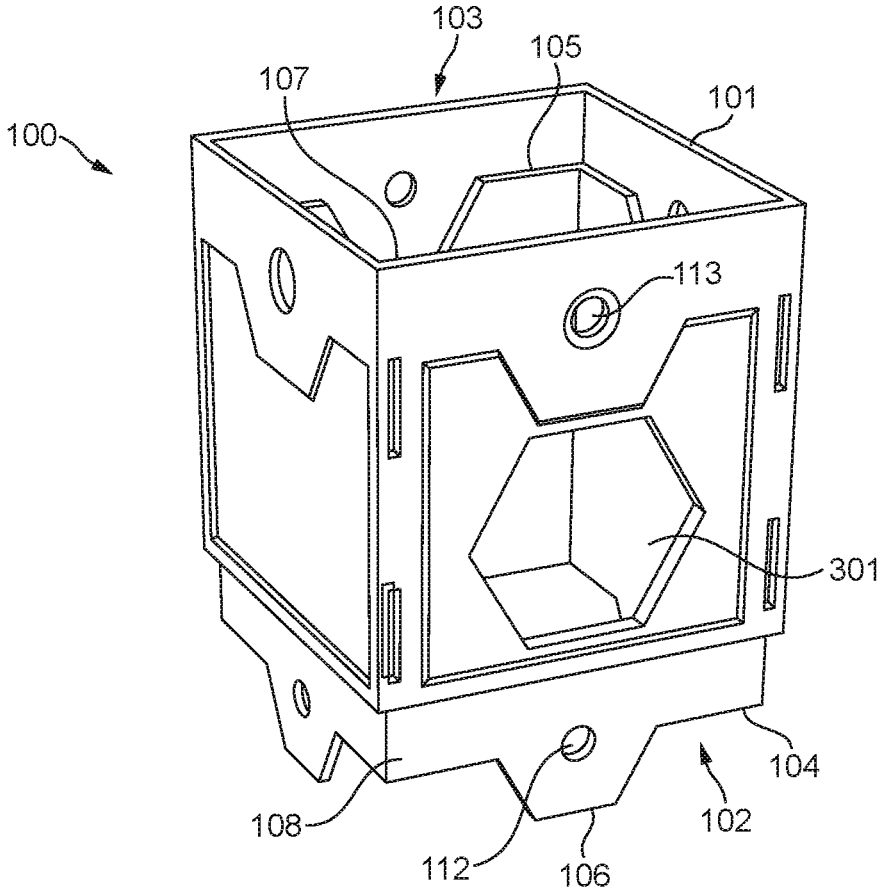
FIG. 3 is a schematic illustration of the modular furnishing block of FIGS. 1A-B comprising an access hole.

Referring to FIG. 3, the modular furnishing block 100 may further comprise an access hole 301, which is provided in the perimeter wall 101. The access hole 301 could be provided in other parts of the modular furnishing block 100, however, this may cause assembly to be less efficient. The access hole 301 shown in FIG. 3 comprises a hexagonal shape (which may be beneficial in terms of strength), however, other shapes could be used, such as square, triangle or circle shapes. In FIG. 3 one access hole 301 is provided in one of the members, however, it is possible for a plurality of access holes 301 to be provided in a plurality of members depending on the design requirements. The access hole 301 may provide access to electrical cables or other items held within the modular furnishing block. Preferably the access hole 301 is large enough for items to be inserted inside the modular furnishing block 100, however, the specific size is dependent on the design requirements.

Figure 4:
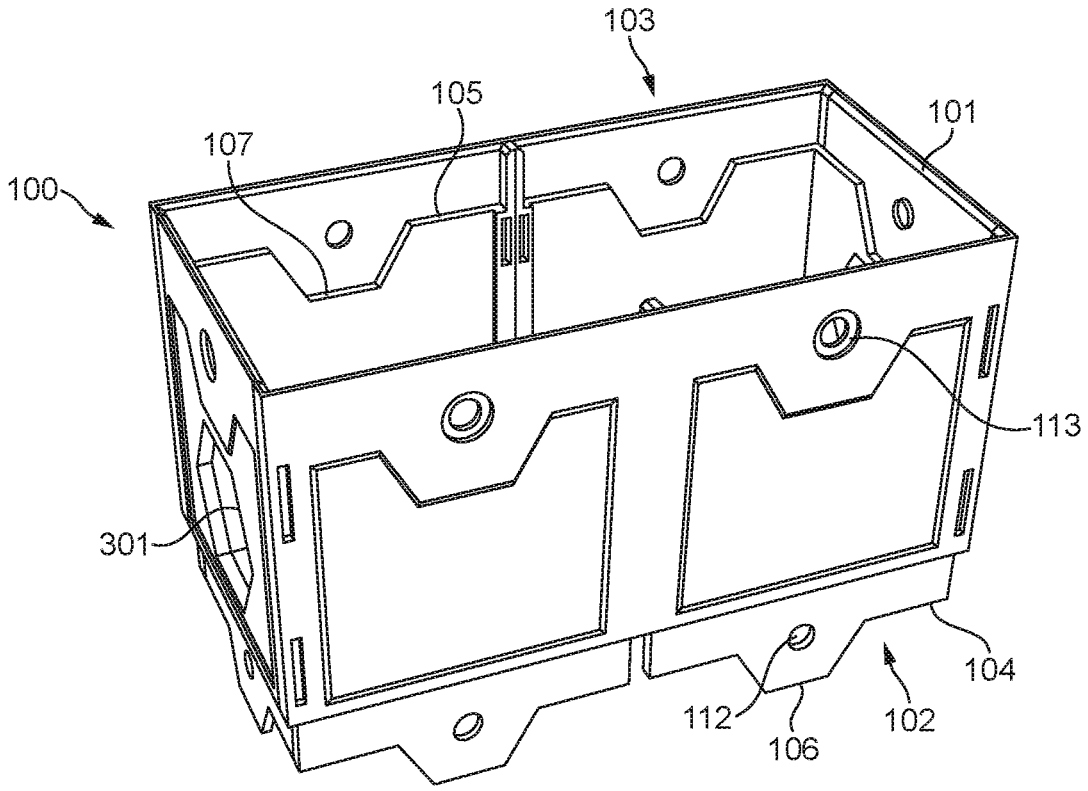
FIG. 4 is a schematic illustration of the modular furnishing block of FIGS. 1A-B comprising a rectangular perimeter wall.

Referring to FIG. 4, the perimeter wall 101 in this embodiment comprises a rectangular shape. In this embodiment, the perimeter wall 101 comprises four members, the same as FIG. 2, however, the second member 202 and the fourth member 204 are longer than in FIG. 2. It is also possible for the perimeter wall 101 to further comprise a fifth member and a sixth member in order to lengthen the sides of the perimeter wall 101 instead of lengthening the second member 202 and the fourth member 204. In this case, it may be required that the second member 202 is locked to the fifth member and the fourth member 204 is locked to the sixth member using one of the locking mechanisms disclosed above. In other embodiments, it may be possible to for perimeter wall 101 to comprise more than six members depending on the design requirements for the modular furnishing block 100. In the embodiment of FIG. 4, the second and fourth member each comprises two third and fourth mating surfaces, that is, two second protrusions and second recesses. Two first and second mating surfaces are also provided on the second and fourth member. The two first mating surfaces 104 are arranged side-by-side, with a gap between them. This allows the rectangular modular furnishing block of FIG. 4 to be engaged with two square modular furnishing blocks on its underside, and optionally two further square modular furnishing blocks on top.

Figure 5:
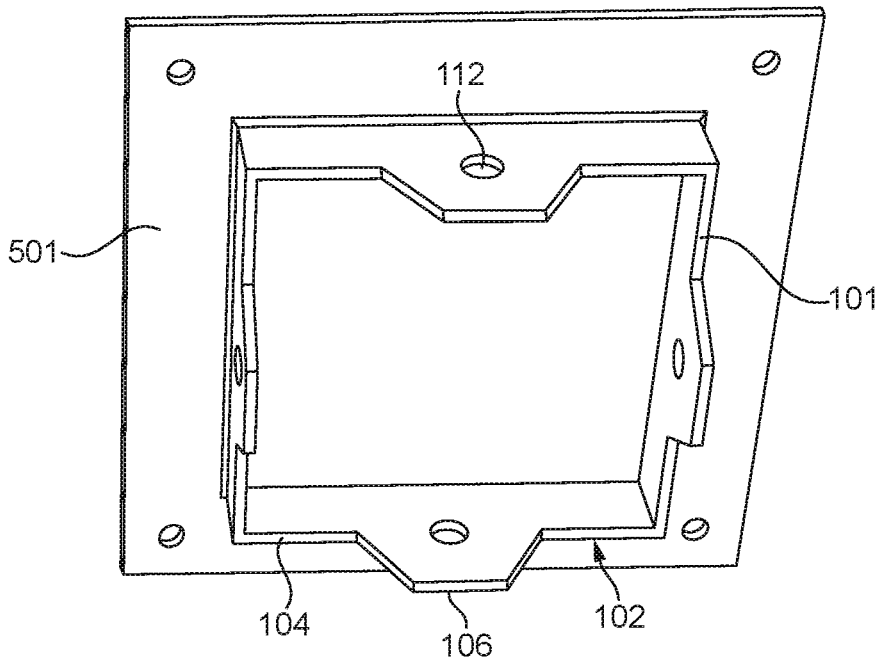
FIG. 5 is a schematic illustration of a lid of the modular furnishing block of FIGS. 1A-B.

Referring to FIG. 5, the modular furnishing block 100 may further comprise a separable lid 501 having a section of perimeter wall 101 corresponding to that of the modular furnishing block 100 itself. The perimeter wall 101 of the lid 501 comprises a first mating surface 104 and a third mating surface 106, having the same shape as the first and third mating surfaces of the modular furnishing block. In use, the lid 501 may rest on the second mating surface 105 and the fourth mating surface 107 of a modular furnishing block 100 in the same way as another modular furnishing block 100 would. It is also possible that the lid 501 could be coupled to a second mating surface 105 and a fourth mating surface 107 of a block 100, or that the lid 501 could be part of the modular furnishing block 100. The lid 501 illustrated in FIG. 5 comprises a panel at its upper end (from which the first and third mating surfaces extend), the panel being arranged to extend substantially perpendicular to the direction of extension of the perimeter wall 101. The panel may be larger than the external dimensions of the modular furnishing block 100. It is also possible for this to be the same size as the end of modular furnishing block 100. If the lid 501 is the same size as the end of the modular furnishing block 100 then a plurality of modular furnishing blocks 100 with a lid 501 can be aligned next to one another. It is also possible for a single lid 501 to comprise a plurality of first mating surfaces 104 and third mating surfaces 106 so that a single lid 501 can couple to a plurality of modular furnishing blocks 100 at the same time.

The lid 501 further comprises a first locking hole 112. The first locking hole 112 passes through the side of the first and/or third projection. The first locking hole 112 of the lid 501 and the second locking hole 113 of the modular furnishing block 100 are arranged to align. This alignment of the first locking hole 112 and the second locking hole 113 occurs when the lid 501 is engaged with the modular furnishing block 100. The alignment of the first locking hole 112 and the second locking hole 113 can enable the lid 501 to be locked to the modular furnishing block 100 with the use of a further locking mechanism. The locking mechanism may be a bar, a pin, a key, a padlock, a clip or any other suitable locking mechanism.

Figure 6:
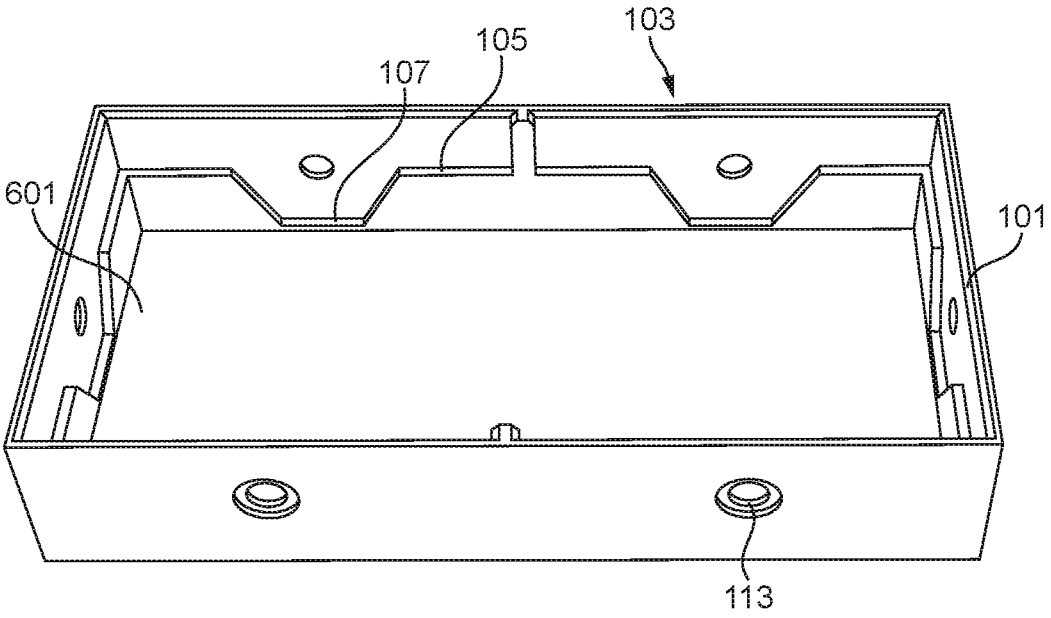
FIG. 6 is a schematic illustration of a base of the modular furnishing block of FIGS. 1A-B.

Referring to FIG. 6, the modular furnishing block 100 may further comprise a base 601 coupled to the second end of the perimeter wall 101. The base 601 may further comprise a second mating surface 105 and a fourth mating surface 107. In use, the first mating surface 104 and the third mating surface 106 may rest on the base 601 (in the same way as they would rest on the second mating surface 105 and a fourth mating surface 107 of a modular furnishing block). It is also possible that the base 601 could be coupled to the first mating surface 104 and the third mating surface 106 or that the base 601 could be part of the modular furnishing block 100. The base 601 illustrated in FIG. 6 comprises a plate at its lower end that is the same size as the outer dimensions of the modular furnishing block 100. It is also possible for this plate to be the larger than the end of modular furnishing block 100. If the base 601 is the same size as the end of the modular furnishing block 100 then a plurality of modular furnishing blocks 100 with a base 601 can be aligned next to one another. In the embodiment of FIG. 6, the base 601 comprises a plurality of second mating surfaces 105 and fourth mating surfaces 107, so that a single base 601 can couple to a plurality of modular furnishing blocks 100. Specifically, two second mating surfaces 105 and fourth mating surfaces 107 are provided side-by-side such that the base can be coupled to two adjacent square modular furnishing blocks (such as those shown in FIG. 1*a*) or one rectangular modular furnishing block (such as that shown in FIG. 4).

The base 601 may further comprise a second locking hole 113. The second locking hole 113 passes through the side of the perimeter wall 101 adjacent to the second and/or fourth void. The second locking hole 113 of the base 601 and the first locking hole 112 of the modular furnishing block 100 are arranged to align. This alignment of the first locking hole 112 and the second locking hole 113 may occur when the base 601 is engaged with the modular furnishing block 100. The alignment of the first locking hole 112 and the second locking hole 113 can enable the base 601 to be locked to the modular furnishing block 100 with the use of a further locking mechanism. The locking mechanism may be a bar, a pin, a key, a padlock, a clip or any other suitable locking mechanism.

FIG. 7 illustrates a modular furnishing block assembly 700 comprising a plurality of modular furnishing blocks 100 in engagement.

Figure 8:
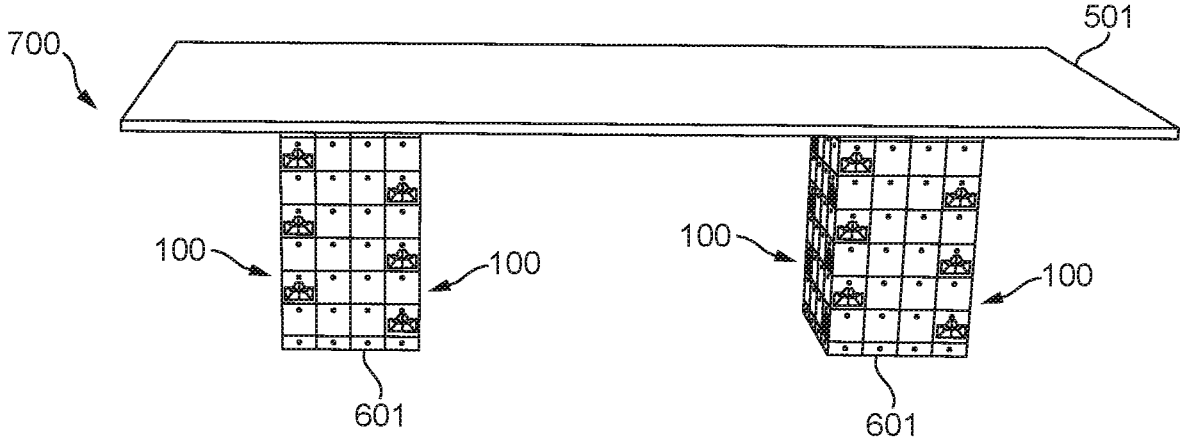
FIG. 8 is a schematic illustration of the modular furnishing block assembly in the form of a table.
Figure 9:
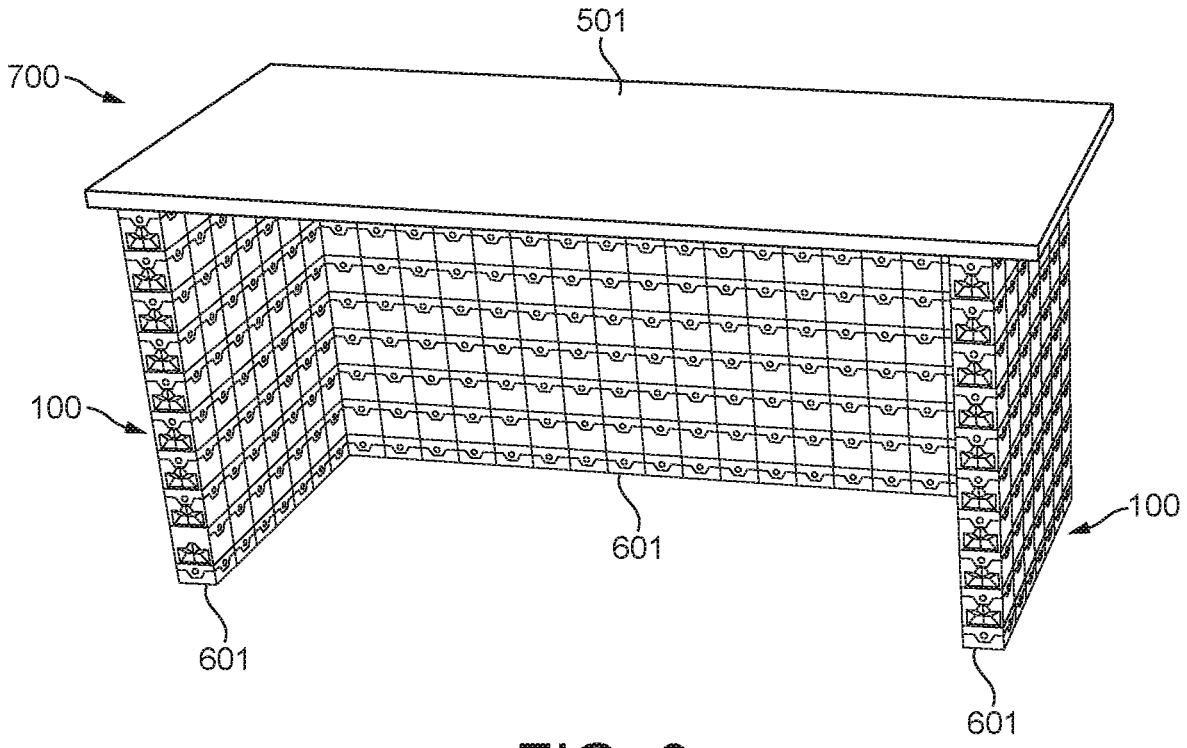
FIG. 9 is a schematic illustration of the modular furnishing block assembly in the form of a desk.

In the embodiment disclosed in FIG. 7, the modular furnishing block assembly 700 comprises a base layer with two bases 601 (such as those shown in FIG. 6) arranged end to end, a first layer with a modular furnishing block 100 with a rectangular perimeter wall 101 and two modular furnishing blocks 100 with square perimeter walls 101 engaged to the base layer (where the two square blocks are on the outside of the rectangular block), and a second layer with two modular furnishing blocks 100 with rectangular perimeter walls 101 engaged to the first layer. The modular nature of the modular furnishing blocks 100 can enable flexibility in the arrangement of the modular furnishing blocks 100 depending on the design requirements. The modular furnishing blocks 100 are arranged to overlap between layers, similar to building construction with bricks, as this can improve the side loading and shear resistance. It is also possible for the modular furnishing block assembly 700 to comprise a lid 501, as shown in FIGS. 8 and 9.

The modular furnishing block 100 assembly may further comprise a covering 701 which is applied to the outside of the perimeter wall 101. In FIG. 7, the covering 701 is only applied to a section of one modular furnishing block 100, however, the covering 701 can be applied to any or all of the modular furnishing blocks 100 depending on the design requirements. The covering 701 may be used to alter the properties and functionality of the modular furnishing block assembly 700, such as by adding strength, adding mass, adding insulation, adding noise damping, adding water resistance or improving appearance. There are a number of ways that the covering 701 could be applied to the modular furnishing block 100, such as adhesive or mechanical fixing means. Optionally, the covering 701 could be configured to engage with the cut-out portion on the members of the perimeter wall.

The modular furnishing block 100 assembly may further comprise a filler 702 disposed inside the perimeter wall 101. In FIG. 7, the filler 702 is shown only inside one modular furnishing block 100, however, the filler 702 can be disposed in any modular furnishing block 100 depending on the design requirements. The filler 702 may be used to alter the properties and functionality of the modular furnishing block assembly 700, such as by adding strength, adding mass, adding insulation or adding noise damping. There are a number of ways that the filler 702 could be disposed into the modular furnishing block 100, such as, the filler 702 could be solid and cut to size to fit into the modular furnishing block 100 or the filler 702 could be poured into the modular furnishing block 100 in liquid form and left to set.

The modular furnishing block 100 may be formed of a variety of materials, for example plastic, preferably a polyester such as Acrylonitrile Butadiene Styrene, ABS, and more preferably recycled ABS. The plastic modular furnishing block 100 may be manufactured using injection moulding, rotational moulding, casting, 3D printing or any other suitable plastic manufacturing process.

Alternatively wood may be used, such as fibre board or solid wood, and preferably reclaimed wood. The wooden modular furnishing block 100 may be manufactured by machining, drilling, sawing or any other suitable wood manufacturing process.

In a further alternative metal may be used, such as aluminium or steel, and preferably recycled metal. The metal modular furnishing block 100 may be manufactured by machining, drilling, casting or 3D printing or any other suitable metal manufacturing process.

The modular furnishing block 100 material may be chosen depending on the design requirements of the modular furnishing block 100. For example, using plastic may result in a lighter modular furnishing block 100 than using metal or wood, however, the modular furnishing block 100 may have a lower strength or noise damping. Using wooden material for the modular furnishing block 100 may result in better insulation but less strength than metal.

The covering 701 for the modular furnishing block 100 may comprise paint or cladding, or both. The paint may be applied to the cladding or directly to the modular furnishing block 100. The paint may improve the appearance of the modular furnishing block 100 and may also improve the water resistance. The cladding may be formed of any of the previously mentioned materials.

FIGS. 8 and 9 illustrate a modular furniture product, comprising the modular furnishing block assembly 700.

FIG. 8 shows a table which comprises two cuboid towers of modular furnishing blocks 100 connected by a single lid 501. The lid includes formations for engaging with a plurality of modular furnishing blocks at different locations. The towers of modular furnishing blocks 100 comprise a plurality of bases 601 at the lower end of the tower.

FIG. 9 shows a desk which comprises one tower (which is 'C' shaped in plan) of modular furnishing blocks 100 fitted with a single lid 501. The tower of modular furnishing blocks 100 comprises a plurality of bases 601 at the lower end of the tower.

The modular furniture product may comprise chairs, desks, tables, shelves, freestanding 'pods' and many other common items. The products may be for outdoor or indoor use. It will be appreciated that, once assembled, the product may be disassembled into individual modular furnishing blocks (and lids and bases, if appropriate). The blocks may then be used to form a different product, or may be placed into storage.

Figure 10:
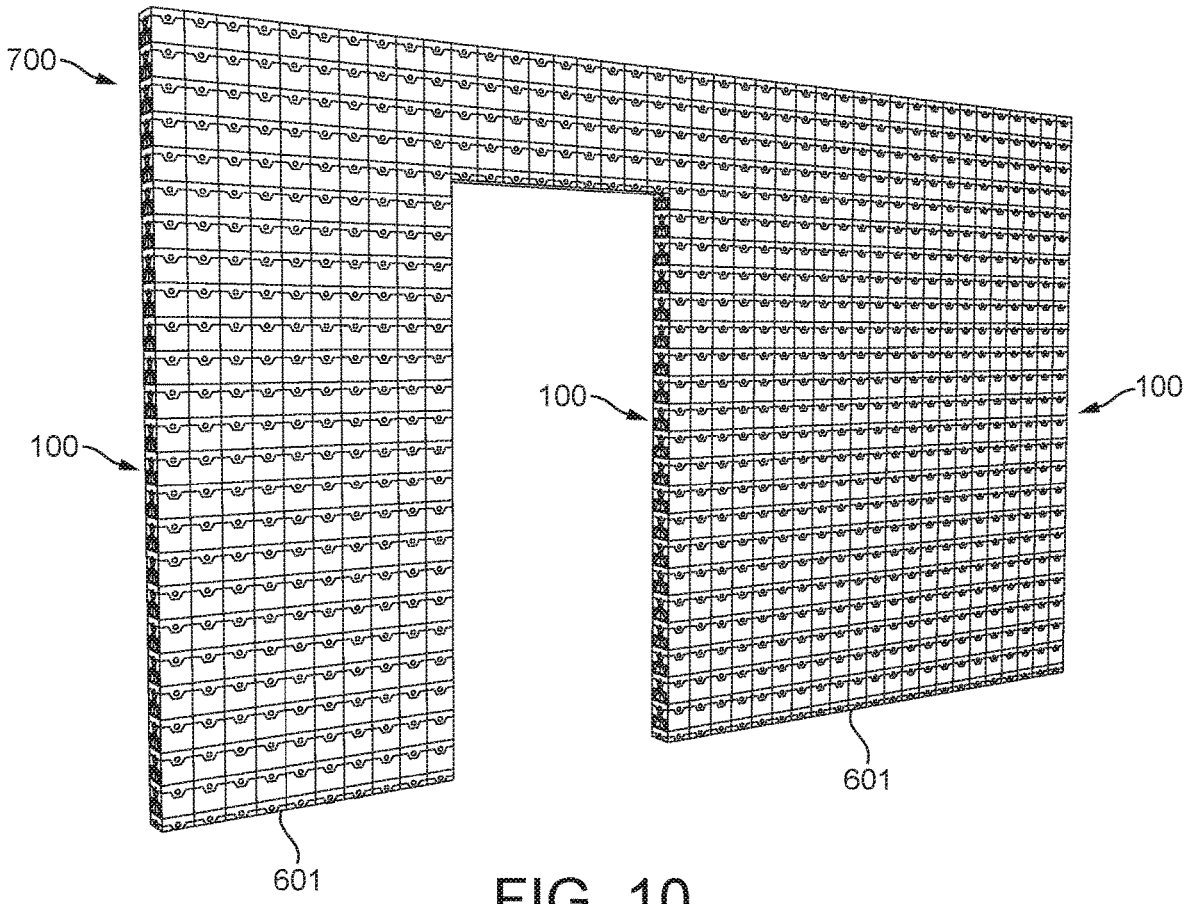
FIG. 10 is a schematic illustration of the modular furnishing block assembly in the form of a wall partition.

FIG. 10 illustrates a modular wall partition, comprising the modular furnishing block assembly 700. The wall partition may further comprise a covering 701 to protect the wall partition or to improve the wall partition properties. In this embodiment the wall partition comprises a hole for a door. The fittings for attaching the door may be fitted to the wall partition directly or to the covering 701.

Second Embodiment

Figure 11:
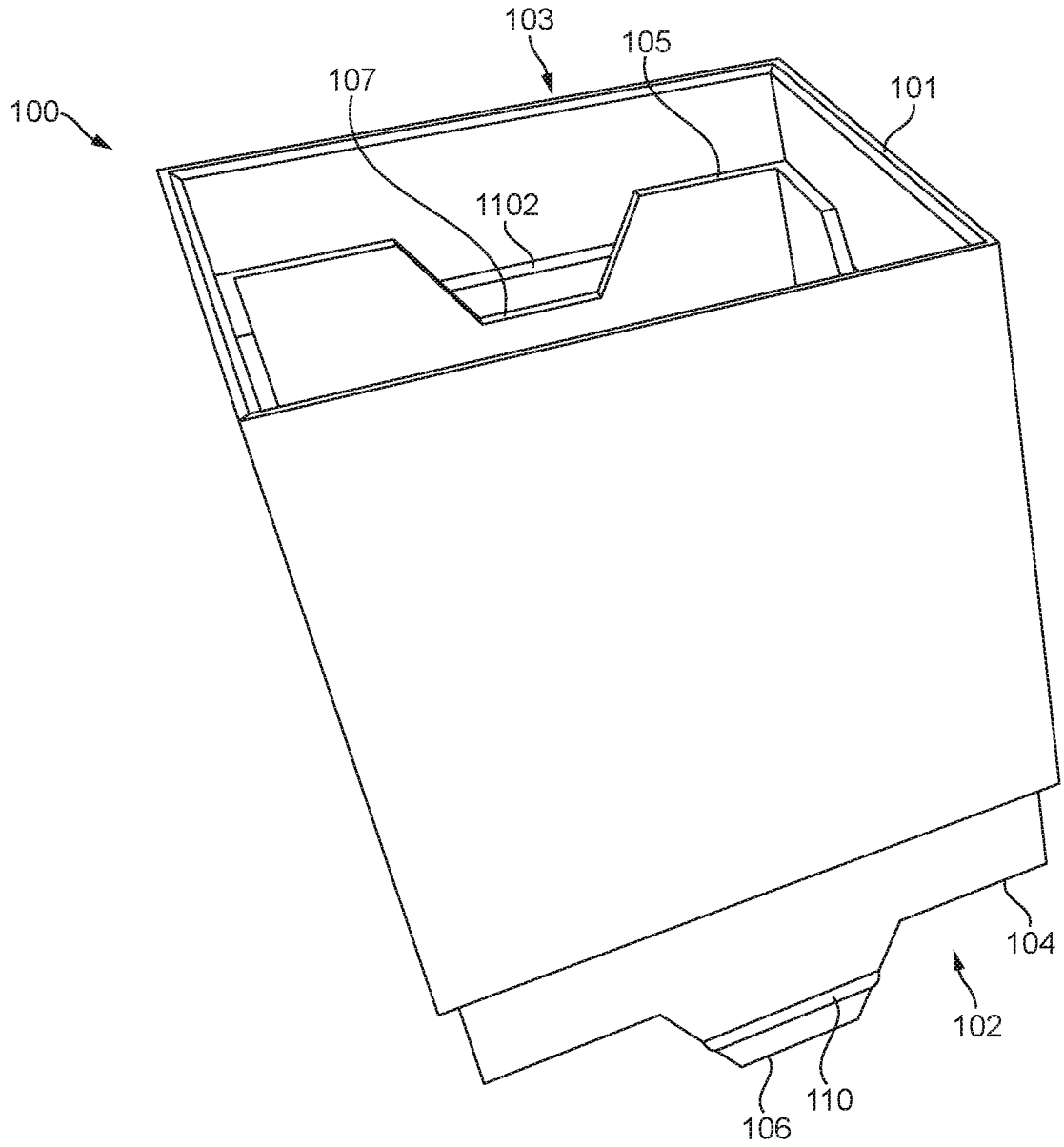
FIG. 11 is a schematic illustration of a modular furnishing block according to a second embodiment of the disclosure.
Figure 12:
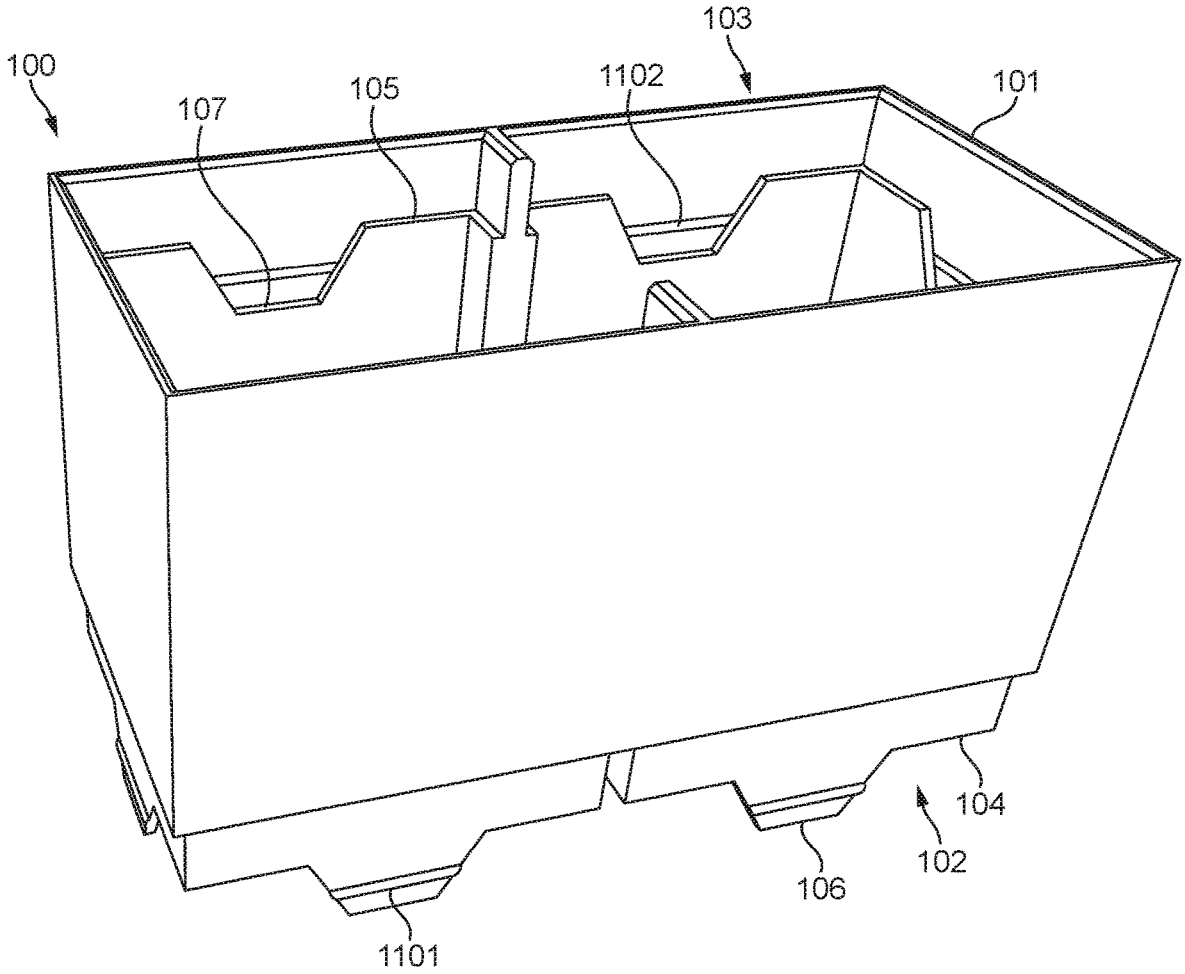
FIG. 12 is a schematic illustration of the modular furnishing block of FIG. 11 comprising a rectangular perimeter wall.
Figure 13:
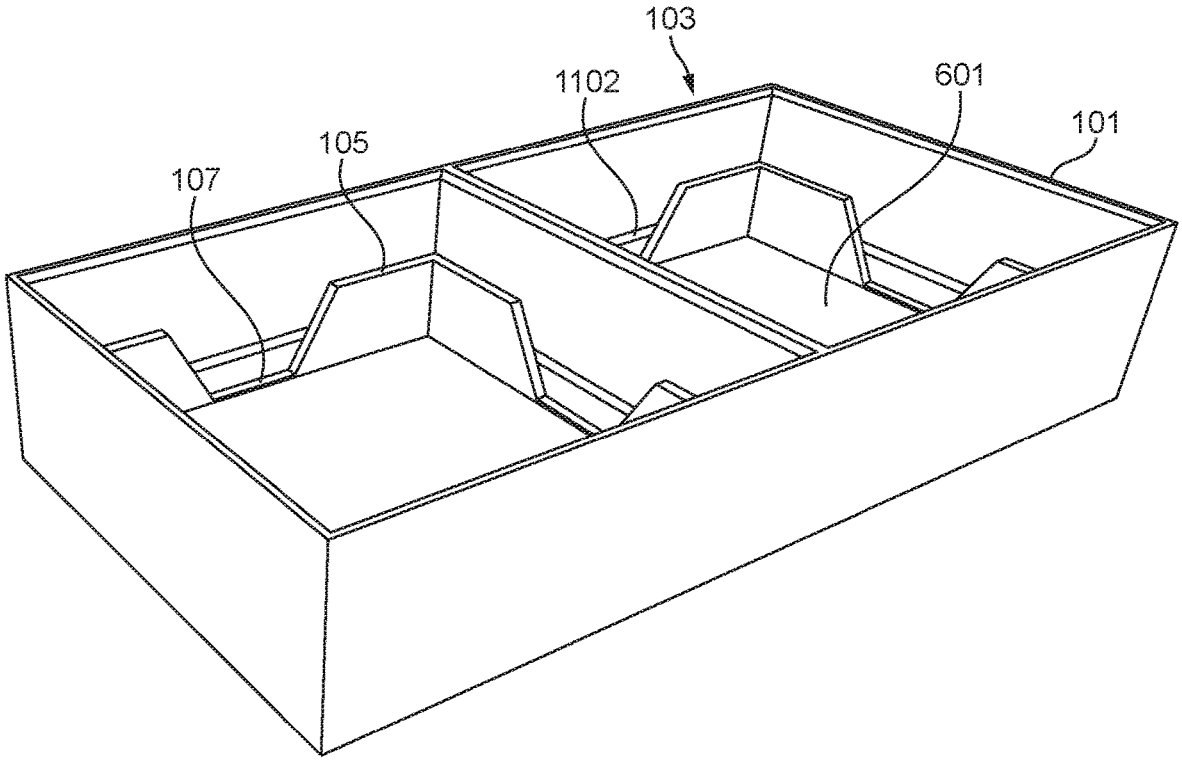
FIG. 13 is a schematic illustration of a base of the modular furnishing block of FIG. 11.

Referring to FIGS. 11 to 13, a modular furnishing block 100 according to a second embodiment is identical to the modular furnishing block 100 according to the first embodiment except that the first formation 102 further comprises a ridge 1101 and the second formation 103 further comprises a groove 1102 and the modular furnishing block 100 does not comprise a locking hole 112/113. The same reference numerals are used in the drawings to denote the same or similar features and only the differences between the second embodiment and the first embodiment are described below, for conciseness.

In the second embodiment, the first formation 102 further comprises a ridge 1101 and the second formation 103 further comprises a groove 1102. The ridge 1101 and the groove 1102 are arranged such that the groove 1102 may accept the ridge 1101 during the engagement of the modular furnishing block 100 with another such modular furnishing block 100. The ridge 1101 and the groove 1101 may enable the modular furnishing block 100 to form a more secure engagement with another such modular furnishing block 100.

FIG. 11 illustrates the modular furnishing block 100 using a representation analogous to that described with reference to FIG. 1 for the first embodiment. It is shown that the ridge 1101 extends from the outer side of the first formation 102 towards the outer side of the perimeter wall 101. In this embodiment, the ridge 1101 comprises a semi-circular, or rounded, cross-section and is aligned parallel to the base of the modular furnishing block 100. It is also possible for the cross-section of the ridge 1101 to form a triangular, square or rectangular cross-section, or not have a constant cross-section along the length of the ridge 1101, or not be aligned parallel to the base of the modular furnishing block 100. In another embodiment it may be possible for first formation 102 to comprise more than one ridge 1101, either arranged in line or in an arbitrary arrangement. The ridge 1101 may comprise a range of shapes as long as the at least one groove 1102 is arranged to accept ridge 1101. Nonetheless, it is preferable for the ridge 1101 to form a rounded shape as this may reduce the friction and likelihood of snagging between ridge 1101 and the inner side of the perimeter wall 101 during the engagement of the modular furnishing blocks 100.

The groove 1102, as shown in FIG. 11, extends into the outer side of the second formation 103 towards the outer side of the perimeter wall 101. In the embodiment illustrated in FIG. 11, the groove 1102 comprises a semi-circular, or rounded, cross-section and is aligned parallel to the base of the modular furnishing block 100. The groove 1102 extends part way into the perimeter wall 101. It is also possible for cross-section of the groove 1102 to form a triangle, square or rectangle cross-section, or not have a constant cross-section along the length of the groove 1102, or not be aligned parallel to the base of the modular furnishing block 100. In another embodiment it may be possible for second formation 103 to comprise more than one groove 1102, either arranged in line or in an arbitrary arrangement. In a further embodiment the groove 1101 may instead be a hole. The groove 1102 may comprise a range of shapes as long as the groove is arranged to accept the at least one ridge 1101.

In the arrangement illustrated in FIG. 11, if the modular furnishing block 100 engages with another such modular furnishing block 100 there may be interference between the ridge 1101 and the inner side of the perimeter wall 101 as the ridge 1101 extends past the inner side of the perimeter wall 101. To enable the modular furnishing blocks 100 to engage the first formation 102 may bend inwards or the second formation 103 may bend outwards while the ridge 1101 passes over the inner side of the perimeter wall 101. In this embodiment, due to the structure of the first formation 102, which is fixed at one end, and the structure of the second formation 103, which is an enclosed wall, with all other properties being equal, the first formation 102 may be more likely to compromise and bend inwards enabling the engagement to occur.

Once the modular furniture blocks 100 are engaged the ridge 1101 is also engaged in the groove 1102. In this embodiment, the ridge 1101 and groove 1102 arrangement is such that the bending of the first formation 102 and the second formation 103 is less, or preferably zero, than when the ridge 1101 passed over the inner side of the perimeter wall 101. Therefore, the modular furnishing blocks 100 are unlikely to be unengaged without significant force, such as the user pulling the modular furnishing blocks 100 apart. Furthermore, in this embodiment, the cross-section of the ridge 1101 and the groove 1102 provides and overlap which causes additional inference in the direction of engagement. A 'snap-fit' arrangement may be provided by way of the cooperating groove and ridge.

FIG. 11 also shows the modular furnishing block 100 with a perimeter wall 101 comprising one continuous member in the shape of a square. It is also possible for the perimeter wall 101 to comprise a plurality of members, as illustrated in the first embodiment. If the second embodiment perimeter wall 101 was to comprise a plurality of members then it would preferably comprise a first member 201, a second member 202, a third member 203 and a fourth member 204 in order to form the square shape.

In the second embodiment, the modular furnishing block 100 does not further comprise a locking hole 112/113 as the locking mechanism is mainly provided by the interaction between the ridge 1101 and the groove 1102. However, it is possible for the modular furnishing block 100 to further comprise a locking hole 112/113 to provide additional locking means. For example, the additional locking means may be a requirement for security or structural loading.

FIG. 12 illustrates a rectangular modular furnishing block 100 using a representation analogous to that described with reference to FIG. 4 for the first embodiment. The difference with this embodiment is that the modular furnishing block 100 does not comprise an access hole 301. It is possible that this embodiment may also comprise an access hole 301.

FIG. 13 illustrates the base 601 using a representation analogous to that described with reference to FIG. 6 for the first embodiment. The difference with this embodiment is that the base 601 further comprises a central perimeter wall 101 section which segments the rectangular base 601 into two square bases 601. This may provide additional strength to the base 601. It is possible that this embodiment may not comprise this additional perimeter wall 101 section.

A cap similar to that of FIG. 5 (but lacking the locking aperture 112) may be used with the modular furnishing block 100 of FIGS. 11 and 12. The cap includes a first formation having a ridge to engage with the second formation and groove 1102 of the modular furnishing block 100. The cap also includes a plate (which extends over the open end of the block in use). The plate may include apertures, which may be generally rectangular apertures arranged towards the edge of the first formation.

The modular furnishing block 100 of FIGS. 11 and 12 may be used to form any of the previously described products.

It will be appreciated that in an alternative features of various different embodiments may be used together in a modular furnishing block 100. For example, the ridge 1101 and groove 107 of the embodiment shown in FIGS. 11 to 13 may be used together with the locking holes 112, 113 of the embodiment shown in FIGS. 1 to 7.

Although the modular furnishing block 100 has principally been described with reference to the first formation 102 is at the lower end of the modular furnishing block, it will be appreciated that the modular furnishing block may be used the other way around (such that the first formation is at the top of the modular furnishing block). This may improve operation of the blocks when used outside, since rainwater will not pool in the recess of the second formation. Where a cap with apertures is used, rainwater may drain out of the block (since the cap is at the lower end of the block). In this 'upside-down' configuration, the block may also stand freely more easily (since the first formation protrudes out of the top, rather than the bottom). However, the configuration with the first formation at the bottom of the block may be easier to use, in particular for indoor applications.

In an alternative embodiment, the modular furnishing block 100 is integrally formed as a single, preferably solid, unit/component. Thus, the perimeter wall 101 comprises one continuous member as opposed to separable members. This may simplify assembly of the block 100 and improve its structural stability.

In a further alternative embodiment, the modular furnishing block 100 is arranged in the opposite (i.e. rotated by 180°) orientation to that shown in FIGS. 1 to 13. In other words, the first end of the modular furnishing block 100 is the upper or top end of the modular furnishing block 100, and the second end of the modular furnishing block 100 is the lower or bottom end of the modular furnishing block 100. Accordingly, the first formation 102 is arranged at the upper or top end of the block 100, and the second formation 103 is arranged at the lower or bottom end of the block 100. The lid 501 may then be coupled to the first end of the perimeter wall 101, and the base 601 may be coupled to the second end of the perimeter wall 101.

Definitions and Alternative Embodiments

The illustrated embodiment, and the alternative embodiments that are described, only represent examples of how the ideas and concepts of the present disclosure can be implemented. Those skilled in the art will recognize that other embodiments for carrying out or practicing the ideas and concepts of the present disclosure are also possible. Modifications to illustrated embodiment, and to the alternative embodiments that are described, are possible without departing from the scope of the present disclosure as defined by the accompanying claims.

Expressions such as "including", "comprising", "incorporating", "have", "is" used to describe and claim the present disclosure are intended to be construed in a nonexclusive manner, namely allowing for items, components or elements not explicitly described also to be present. Reference to the singular is also to be construed to relate to the plural.

Reference numerals appearing in the claims are by way of illustration only and shall have no limiting effect on the scope of the claims.

Each feature disclosed in the description, and, where appropriate, the claims and drawings may be provided independently or in any appropriate combination.

The invention claimed is:

1. A modular furnishing block, the modular furnishing block being engageable with another such modular furnishing block to provide a modular furnishing block assembly, the modular furnishing block comprising:

a perimeter wall providing the sides of the modular furnishing block;

a first formation raised from a first surface of the perimeter wall;

a second formation recessed from a second surface of the perimeter wall;

wherein the first formation and second formation extend along the entire perimeter wall;

wherein, when the modular furnishing block engages with the other such modular furnishing block to provide the modular furnishing block assembly, the first surface of the perimeter wall of the modular furnishing block abuts the second surface of the perimeter wall of the other such modular furnishing block, wherein a width of the first formation in a dimension along an inner side of the perimeter wall tapers away from the first surface and a width of the second formation in the dimension along the inner side of the perimeter wall tapers away from the second surface such that, as the modular furnishing block is moved towards engagement with the other such modular furnishing block to provide the modular furnishing block assembly, the first formation fits within the second formation progressively more closely in the dimension along the perimeter wall;

wherein the first formation is spaced from an outer edge of the first surface and the second formation is spaced from an outer edge of the second surface;

wherein the first formation is located at an inner edge of the first surface, and the second formation is located at an inner edge of the second surface; and wherein the inner edge of the first surface and the inner edge of the second surface are aligned with the inner side of the perimeter wall.

2. The modular furnishing block of claim 1, wherein the first formation comprises a first mating surface and the second formation comprises a second mating surface, and wherein, when the modular furnishing block engages with the other such modular furnishing block to provide the modular furnishing block assembly, the first mating surface of the modular furnishing block abuts and/or rests on the second mating surface of the other such modular furnishing block.

3. The modular furnishing block of claim 1, wherein the outer edge of the first surface is aligned with the outer edge of the second surface.

4. The modular furnishing block of claim 1, wherein the first formation further comprises a third mating surface raised from a third surface on the first mating surface; and a fourth mating surface recessed from a fourth surface on the second mating surface.

5. The modular furnishing block of claim 4, wherein, when the modular furnishing block engages with the other such modular furnishing block to provide the modular furnishing block assembly, the third mating surface of the modular furnishing block abuts and/or rests on the fourth mating surface of the other such modular furnishing block.

6. The modular furnishing block of claim 4, wherein the area of the third surface is smaller than or the same as the total area of the first mating surface.

7. The modular furnishing block of claim 4, wherein the area of the third mating surface is smaller than or the same as the area of the fourth mating surface.

8. The modular furnishing block of claim 1, wherein the first formation further comprises at least one ridge extending in a direction towards the outer side of the perimeter wall and the second formation further comprises at least one groove extending in a direction towards the outer side of the perimeter wall.

9. The modular furnishing block of claim 1, wherein the first formation further comprises a first locking hole and the second formation further comprises a second locking hole.

10. The modular furnishing block of claim 1, wherein the modular furnishing block further comprises at least one of: a lid coupled to the first end of the perimeter wall; a base coupled to the second end of the perimeter wall; a filler disposed inside the perimeter wall; and an access hole provided in the perimeter wall.

11. The modular furnishing block of claim 1, wherein the perimeter wall is formed of first, second, third, and fourth separable members.

12. The modular furnishing block of claim 1, wherein the modular furnishing block is integrally formed as a single unit.

13. The modular furnishing block of claim 1, wherein the perimeter wall has a shape which is capable of being tessellated.

14. The modular furnishing block of claim 1, wherein the modular furnishing block is formed of any of the following:

plastic;

wood; and metal.

15. The modular furnishing block of claim 1, wherein the modular furnishing block further comprises a covering, wherein the covering is applied to the outside of the perimeter wall.

16. A modular furnishing block assembly, comprising the modular furnishing block of claim 1 engaged to at least one other such modular furnishing block.

17. A modular furnishing block assembly according to claim 16, wherein the modular furnishing block assembly forms part of a modular furniture product or a modular wall partition.

18. A modular furnishing block kit of parts, comprising the modular furnishing block of claim 1 and at least one other such modular furnishing block.

* * * * *